US008693913B2

(12) United States Patent
Ishizuka

(10) Patent No.: US 8,693,913 B2
(45) Date of Patent: Apr. 8, 2014

(54) IMAGE FORMING APPARATUS

(75) Inventor: Tetsuo Ishizuka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 226 days.

(21) Appl. No.: 13/368,937

(22) Filed: Feb. 8, 2012

(65) Prior Publication Data

US 2013/0028626 A1 Jan. 31, 2013

(30) Foreign Application Priority Data

Jul. 29, 2011 (JP) ..... 2011-167237

(51) Int. Cl.
*G03G 15/00* (2006.01)

(52) U.S. Cl.
CPC ..... *G03G 15/80* (2013.01)
USPC ..... 399/88; 399/90

(58) Field of Classification Search
CPC G03G 15/80; G03G 21/1652; G03G 221/166
USPC ..... 399/88, 90
See application file for complete search history.

(56) References Cited

U.S. PATENT DOCUMENTS

| | | | | |
|---|---|---|---|---|
| 7,734,214 | B2 * | 6/2010 | Masuda | 399/107 |
| 2002/0168197 | A1 * | 11/2002 | Kitozaki | 399/88 |
| 2005/0025514 | A1 * | 2/2005 | Kitozaki | 399/88 |

FOREIGN PATENT DOCUMENTS

| | | | |
|---|---|---|---|
| JP | 2003-295909 | A | 10/2003 |
| JP | 2007-261240 | A | 10/2007 |
| JP | 2009-266948 | A | 11/2009 |

* cited by examiner

*Primary Examiner* — Walter L Lindsay, Jr.
*Assistant Examiner* — Roy Y Yi
(74) *Attorney, Agent, or Firm* — Sughrue Mion, PLLC

(57) ABSTRACT

An image forming apparatus includes a control board, a first connection terminal provided on an outer surface of the control board, an installation section disposed at the outer surface side of the control board, a substrate capable of being installed into the installation section, a second connection terminal provided on a first surface of the substrate and connected to the first connection terminal, a grip portion provided on a second surface of the substrate at a first end thereof in an in-plane direction, and an external connection terminal provided on the substrate so as to project from the substrate at a second end thereof in the in-plane direction. The external connection terminal is externally exposed to allow an external device to be connected thereto when the substrate is installed into the installation section after the external connection terminal is inserted through an opening in the apparatus body.

8 Claims, 12 Drawing Sheets

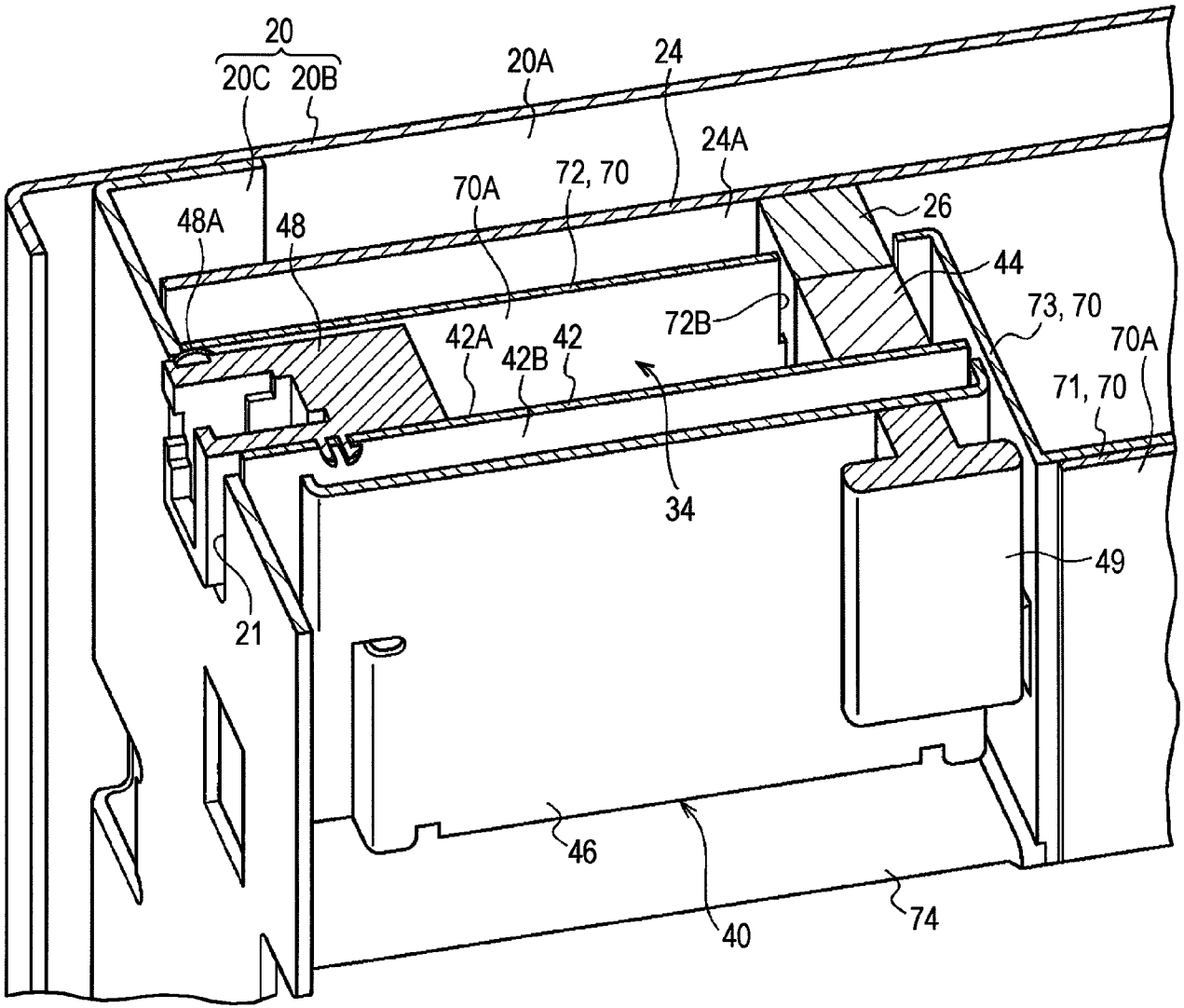
FIG. 5
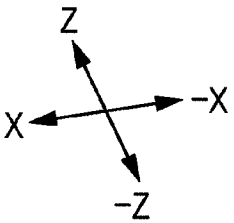

IMAGE FORMING APPARATUS

CROSS-REFERENCE TO RELATED APPLICATIONS

This application is based on and claims priority under 35 USC 119 from Japanese Patent Application No. 2011-167237 filed Jul. 29, 2011.

BACKGROUND

The present invention relates to an image forming apparatus.

SUMMARY

According to an aspect of the invention, there is provided an image forming apparatus including a control board, a first connection terminal, an installation section, a substrate, a second connection terminal, a grip portion, and an external connection terminal. The control board is provided in an apparatus body and controls an image forming operation. The first connection terminal is provided on an outer surface of the control board. The installation section is disposed at the outer surface side of the control board in the apparatus body. The substrate is capable of being installed into the installation section in a thickness direction of the control board in a manner such that a first surface of the substrate faces the outer surface of the control board. The second connection terminal is provided on the first surface of the substrate and is connected to the first connection terminal when the substrate is installed into the installation section. The grip portion is provided on a second surface of the substrate at a first end of the substrate in an in-plane direction. The external connection terminal is provided on the substrate so as to project from the substrate at a second end of the substrate in the in-plane direction. The external connection terminal is externally exposed to allow an external device to be connected to the external connection terminal when the substrate is installed into the installation section after the external connection terminal is inserted through an opening in the apparatus body.

BRIEF DESCRIPTION OF THE DRAWINGS

An exemplary embodiment of the present invention will be described in detail based on the following figures, wherein:

FIG. 5 is a perspective cutaway view of a card installation section and a network card installed in the card installation section;

DETAILED DESCRIPTION

An exemplary embodiment of the present invention will now be described with reference to the drawings.

Structure of Image Forming Apparatus According to Present Embodiment

Figure 1:
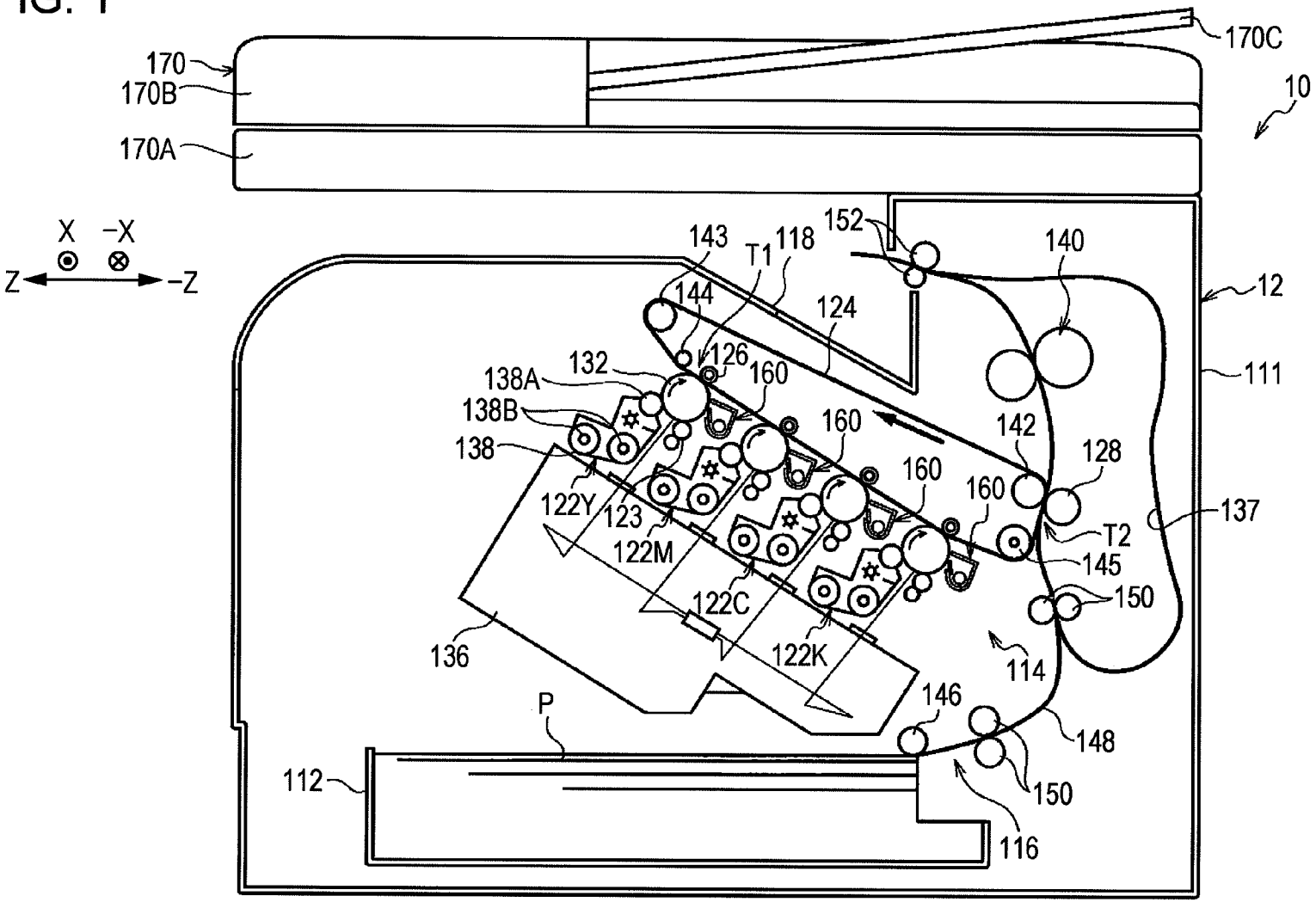
FIG. 1 illustrates the structure of an image forming apparatus.

The structure of an image forming apparatus according to the present exemplary embodiment will now be described. FIG. 1 illustrates the structure of the image forming apparatus 10 according to the present exemplary embodiment. In the following descriptions, an X direction, a −X direction, a Z direction, and a −Z direction are defined as illustrated in the figures. In the figures, circles having the "x" marks therein show the direction from front to back with respect to the sides illustrated in the figures, and circles having dots at the center show the direction from back to front with respect to the sides illustrated in the figures.

Referring to FIG. 1, the image forming apparatus 10 includes an apparatus body 12 that includes various components and a control board 24 (see FIG. 4), which is an example of a controller that controls operations of various units in the image forming apparatus 10. The apparatus body 12 includes a housing 111 that houses a storage unit 112 that stores recording media P, such as sheets of paper, an image forming section 114 that forms images on the recording media P, and a transport unit 116 that transports the recording media P from the storage unit 112 to the image forming section 114. An ejection unit 118 to which the recording media P are ejected after the images are formed thereon by the image forming section 114 is provided in the upper section of the housing 111.

The image forming section 114 includes image forming units 122Y, 122M, 122C, and 122K (122Y to 122K hereinafter) that form toner images of respective colors, which are yellow (Y), magenta (M), cyan (C), and black (K); an intermediate transfer belt 124 onto which the toner images formed by the image forming units 122Y to 122K are transferred; first transfer rollers 126 that transfer the toner images formed by the image forming units 122Y to 122K onto the intermediate transfer belt 124; and a second transfer roller 128 that transfers the toner images that have been transferred onto the intermediate transfer belt 124 by the first transfer rollers 126 onto a recording medium P. The structure of the image forming section 114 is not limited to the above-described structure, and may have other structures as long as an image may be formed on the recording medium P.

The image forming units 122Y to 122K are arranged next to each other in the housing 111 along a line that is inclined with respect to the horizontal direction. Each of the image forming units 122Y to 122K includes a photoconductor 132 that rotates in one direction, for example, clockwise in FIG. 1. The image forming units 122Y to 122K have similar structures. Therefore, reference numerals for components of the image forming units 122M, 122C, and 122K are omitted in FIG. 1.

A charging roller 123, a developing device 138, and a removing device 160 are arranged around each photoconductor 132 in that order from an upstream side in the rotating direction of the photoconductor 132. The charging roller 123 is an example of a charging device that charges the photoconductor 132. The developing device 138 forms a toner image by developing an electrostatic latent image that is formed on the photoconductor 132 when the photoconductor 132 is subjected to an exposure process performed by an exposure device 136, which will be described below, after being charged by the charging roller 123. The removing device 160 removes developer that remains on the photoconductor 132 after the toner image is transferred.

The exposure device 136 is disposed at a position obliquely below the image forming units 122Y to 122K. The exposure device 136 forms the electrostatic latent image on each photoconductor 132 by subjecting the photoconductor 132 that has been charged by the charging roller 123 to the exposure process. The exposure device 136 forms the electrostatic latent image on the basis of an image signal transmitted from the control board 24. The image signal transmitted from the control board 24 may be, for example, an image signal received by the control board 24 from an external device.

The developing device 138 includes a developer supplying member 138A that supplies the developer to the photoconductor 132 and plural transporting members 138B that transport the developer to the developer supplying member 138A while agitating the developer.

The intermediate transfer belt 124 is loop-shaped and is disposed above the image forming units 122Y to 122K. Wrap rollers 142, 143, 144, and 145 around which the intermediate transfer belt 124 is wrapped are disposed inside the intermediate transfer belt 124. When one of the wrap rollers 142, 143, 144, and 145 is rotated, the intermediate transfer belt 124 rotates in one direction, for example, counterclockwise in FIG. 1, while being in contact with each photoconductor 132. The wrap roller 142 functions as a counter roller that is opposed to the second transfer roller 128.

Each first transfer roller 126 faces the corresponding photoconductor 132 with the intermediate transfer belt 124 interposed therebetween. The position between the first transfer roller 126 and the photoconductor 132 is defined as a first transfer position T1 at which the toner image formed on the photoconductor 132 is transferred onto the intermediate transfer belt 124.

The second transfer roller 128 faces the wrap roller 142 with the intermediate transfer belt 124 interposed therebetween. The position between the second transfer roller 128 and the wrap roller 142 is defined as a second transfer position T2 at which the toner images on the intermediate transfer belt 124 are transferred onto the recording medium P.

The transport unit 116 includes a feed roller 146, a transport path 148, and plural transport rollers 150. The feed roller 146 feeds a recording medium P from the storage unit 112. The recording medium P fed by the feed roller 146 is transported along the transport path 148. The transport rollers 150 are arranged along the transport path 148 and transport the recording medium P fed by the feed roller 146 to the second transfer position T2.

A fixing device 140 is disposed downstream of the second transfer position T2 in the transporting direction. The fixing device 140 fixes the toner image formed on the recording medium P by the image forming section 114 to the recording medium P. Ejection rollers 152 that eject the recording medium P to the ejection unit 118 after the toner image is fixed to the recording medium P are disposed downstream of the fixing device 140 in the transporting direction.

A reverse transport path 137 is disposed at the side opposite to (in the −Z direction from) the intermediate transfer belt 124 with the transport path 148 disposed therebetween. The reverse transport path 137 reverses the recording medium P to which the toner image is fixed at one side thereof, and transports the recording medium P to the second transfer position T2 again. In the case where images are to be formed on both sides of the recording medium P, after the toner image is fixed to the recording medium P at one side thereof, the recording medium P is transported in a switchback manner by the ejection rollers 152 and is guided by the reverse transport path 137 so as to return to the second transfer position T2.

An image forming operation performed by the image forming apparatus 10 according to the present exemplary embodiment to form an image on the recording medium P will now be described.

In the image forming apparatus 10 according to the present exemplary embodiment, the recording medium P fed from the storage unit 112 by the feed roller 146 is transported to the second transfer position T2 by the transport rollers 150.

In each of the image forming units 122Y to 122K, the photoconductor 132 is charged by the charging roller 123 and is subjected to the exposure process performed by the exposure device 136, so that an electrostatic latent image is formed on the photoconductor 132. The electrostatic latent image is developed by the developing device 138, so that a toner image is formed on the photoconductor 132. The toner images of respective colors formed by the image forming units 122Y to 122K are transferred onto the intermediate transfer belt 124 at the first transfer positions T1 in a superimposed manner. Thus, a color image is formed on the intermediate transfer belt 124. The color image formed on the intermediate transfer belt 124 is transferred onto the recording medium P at the second transfer position T2.

The recording medium P onto which the toner images have been transferred is transported to the fixing device 140, which fixes the toner images to the recording medium P. In the case where an image is to be formed on only one side of the recording medium P, the recording medium P is ejected to the ejection unit 118 by the ejection rollers 152 after the toner images are fixed. In the case where images are to be formed on both sides of the recording medium P, the recording medium P is transported in a switchback manner by the ejection rollers 152 after an image is formed on the recording medium P at one side thereof. The recording medium P is reversed and transported to the reverse transport path 137. Then, the recording medium P is transported along the reverse transport path 137 to the second transfer position T2 again, and an image is formed in a manner similar to that described above on the recording medium P at the side at which no image has been recorded. Thus, images are formed on both sides of the recording medium P. Then, the recording medium P is ejected to the ejection unit 118 by the ejection rollers 152. The image forming operation is performed in the above-described manner.

Figure 2:
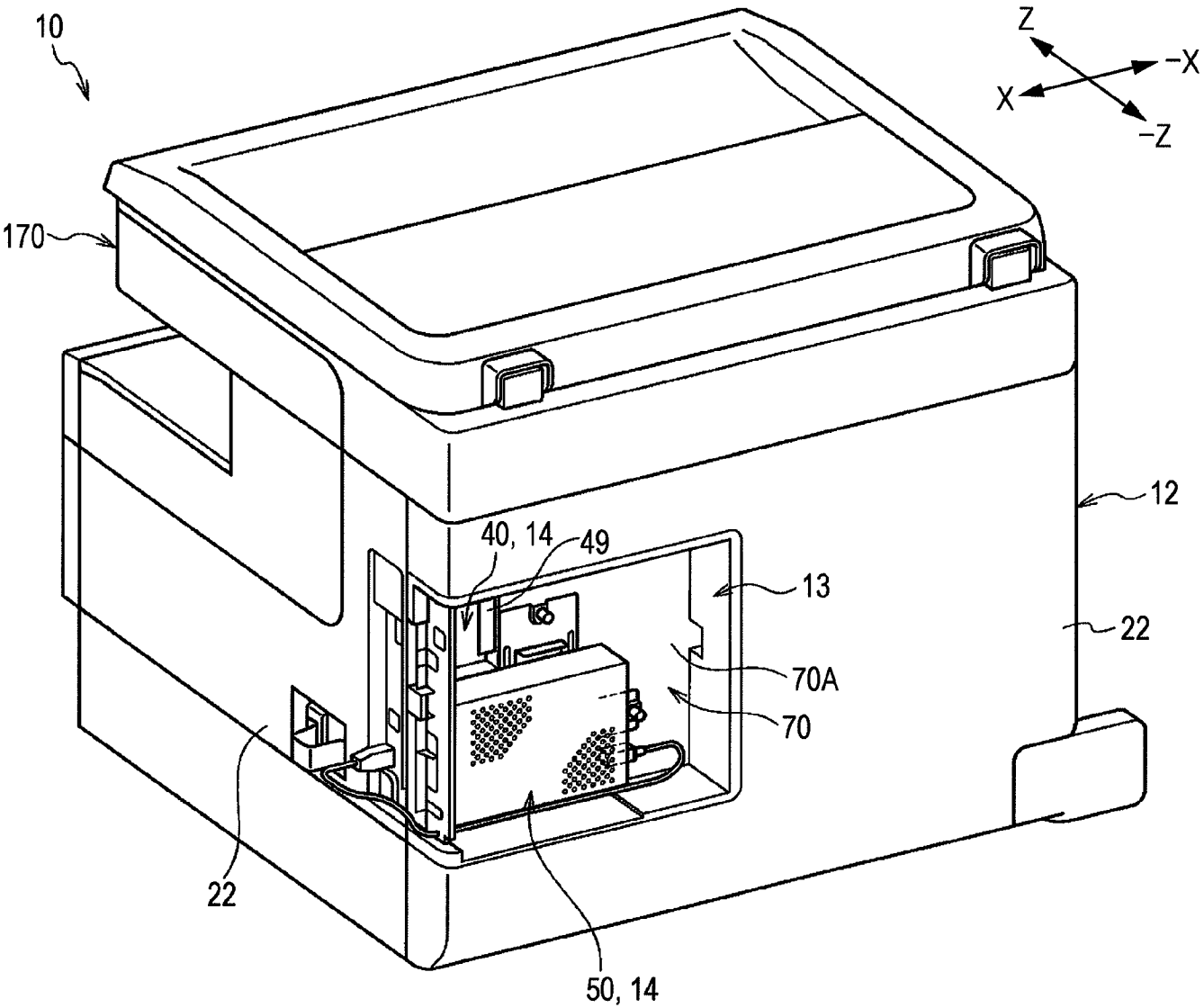
FIG. 2 is a perspective view illustrating the structure of an installation area in the image forming apparatus.
Figure 3:
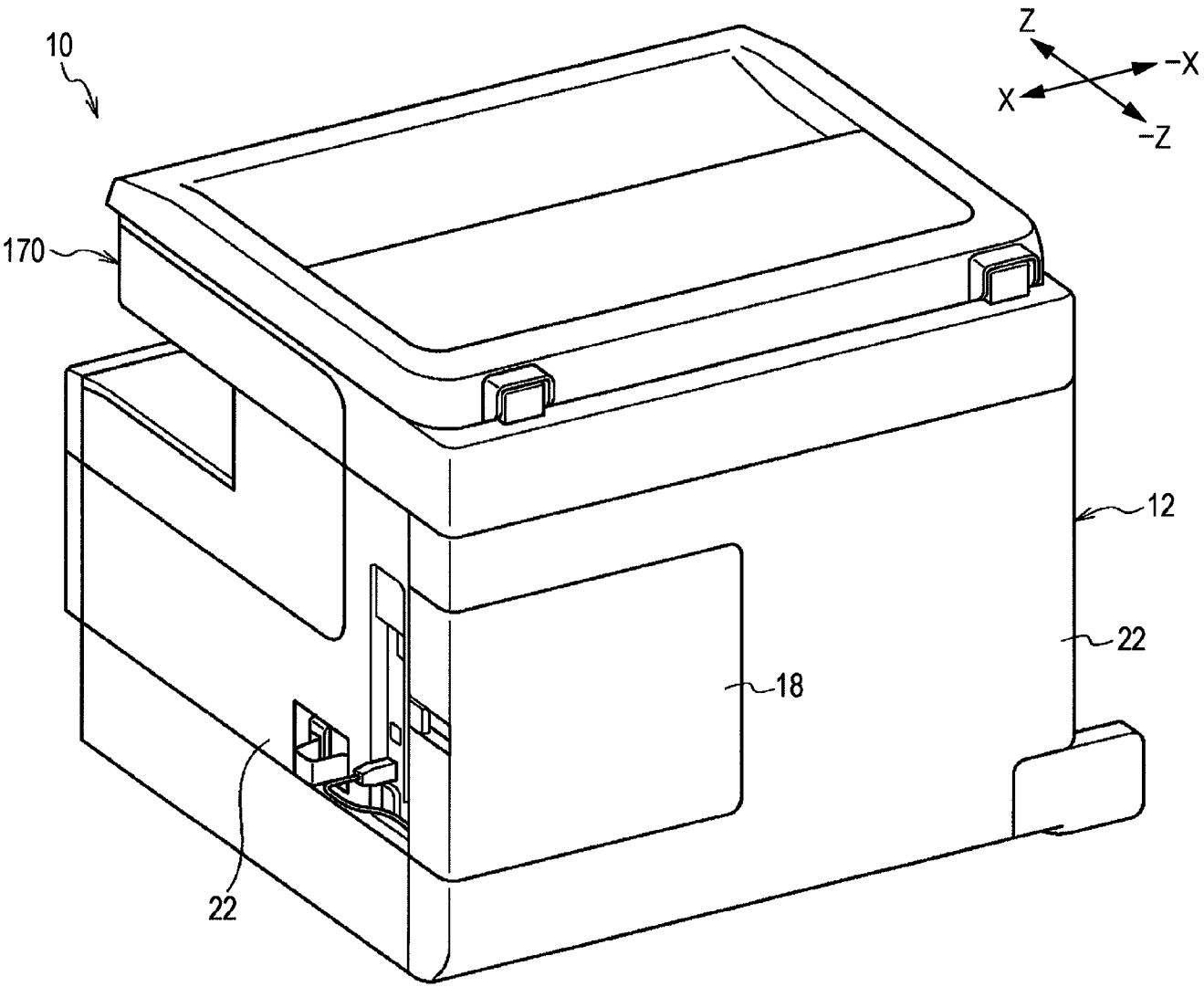
FIG. 3 is a perspective view illustrating the state in which the installation area illustrated in FIG. 2 is covered with a cover.
Figure 7:
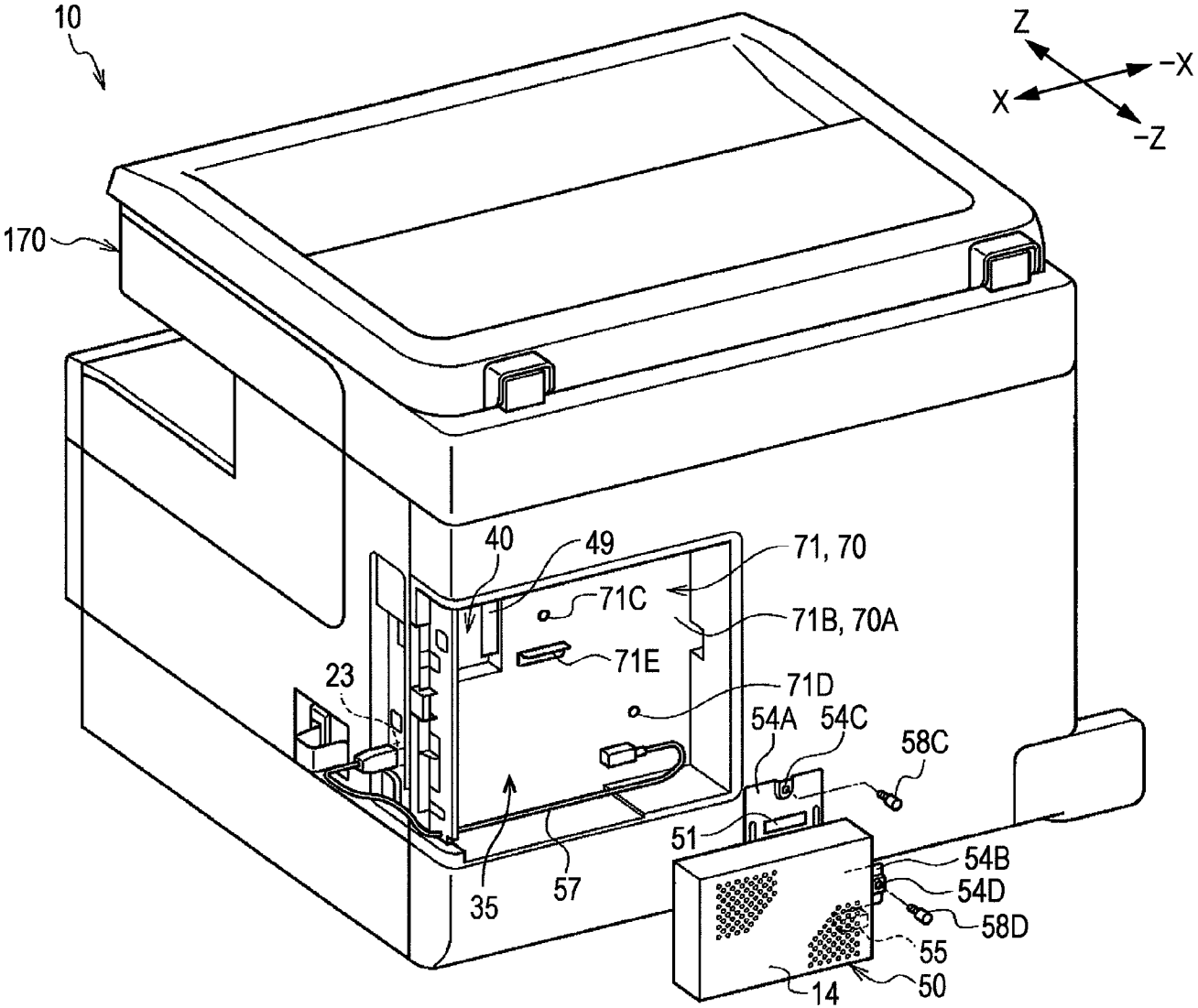
FIG. 7 is a perspective view illustrating the state in which a facsimile unit is removed from a unit installation section.

Referring to FIG. 1, an image reading device 170 is provided in the upper section of the image forming apparatus 10. The image reading device 170 includes an image reading unit 170A capable of reading an image on a document and an opening-closing unit 170B that is capable of being opened or closed with respect to the top surface of the image reading unit 170A. In the image reading device 170, the opening-closing unit 170B is opened and a document is placed on the top surface of the image reading unit 170A. In this state, the image on the document may be read by the image reading unit 170A. The opening-closing unit 170B includes a document transporting device 170C that transports the document. The image reading unit 170A may read the image on the document transported by the document transporting device 170C. The image forming apparatus 10 is capable of forming an image on a recording medium on the basis of the image read by the image reading device 170. In FIGS. 2, 3, and 7, the image reading device 170 is drawn in a simplified form.

Structure of Installation Area

As illustrated in FIG. 2, the image forming apparatus 10 includes an installation area 13 in which an additional component 14 that provides an additional function for the image forming apparatus 10 may be installed. The installation area 13 is configured so that the additional component 14 may be installed therein by a user.

As illustrated in FIG. 3, a cover 18 that covers the installation area 13 is detachably attached to the apparatus body 12 of the image forming apparatus 10. The installation area 13 is exposed when the cover 18 is removed from the apparatus body 12. In this state, the additional component 14 may be installed into the installation area 13.

The additional component 14 may be, for example, a network card 40 that provides a network function for the image forming apparatus 10 or a facsimile unit 50 that provides a facsimile function for the image forming apparatus 10. The additional component 14 is not limited to the above-described components, and components that provide other functions may also be used as the additional component 14.

Figure 4:
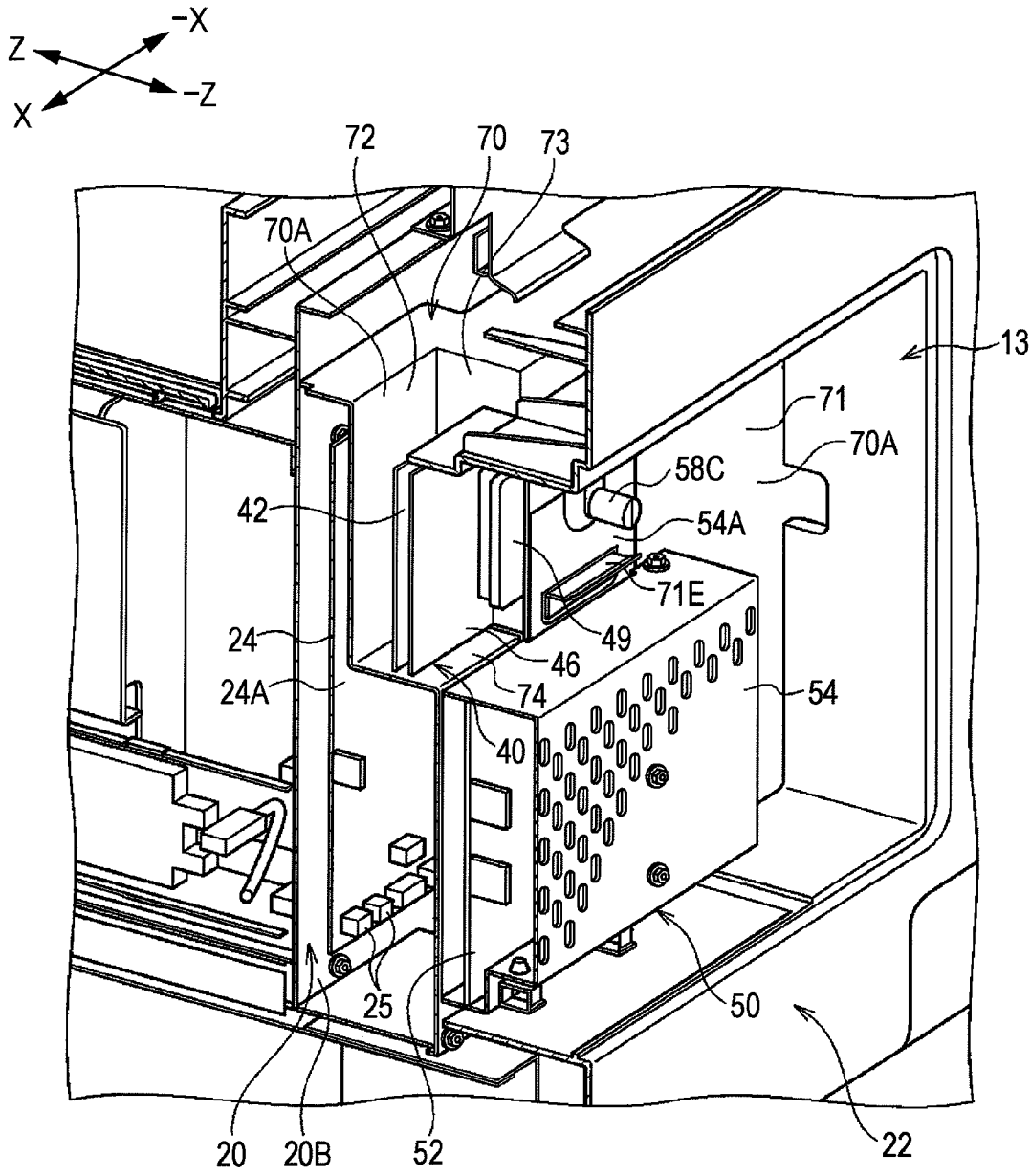
FIG. 4 is a perspective cutaway view of the installation area illustrated in FIG. 2.

As illustrated in FIG. 4, the apparatus body 12 includes a body frame 20, which is a structure element, and an outer cover 22, which is an outer member. Referring to FIG. 5, the body frame 20 includes a rear frame 20B and a protruding frame 20C. The rear frame 20B is disposed behind (in the −Z direction from) the image forming section 114 (see FIG. 1). The protruding frame 20C protrudes rearward (in the −Z direction) from the end of the rear frame 20B in the X direction. The protruding frame 20C is formed in an L-shape in plan view.

The above-described control board 24 is disposed adjacent to an outer surface 20A of the rear frame 20B. The outer surface is a surface of the apparatus body 12 facing outward (in the −Z direction), and is at the side opposite to the surface facing the inside in which the image forming section 114 is disposed.

As described above, the control board 24 controls the overall operation of the image forming apparatus 10 including the image forming operation. Electronic components 25 (see FIG. 4) and a control-board connector 26, which is an example of a first connection terminal, are arranged on an outer surface 24A of the control board 24.

A shield plate 70 is disposed adjacent to the outer surface 24A of the control board 24. The shield plate 70 is an example of a shielding member that is arranged in the apparatus body 12 so as to cover the outer surface 24A of the control board 24 and that electrically shields the control board 24. The shield plate 70 is electrically connected to the body frame 20, which serves as a point of reference potential, by being fixed to, for example, the protruding frame 20C. Accordingly, the influence of electrical noise on the control board 24 may be reduced.

A card installation section 34 and a unit installation section 35 (see FIGS. 6 and 7) are provided on an outer surface 70A of the shield plate 70. The card installation section 34 is an example of an installation section that allows the network card 40 to be installed therein. The unit installation section 35 allows the facsimile unit 50 to be installed therein. Thus, the card installation section 34 and the unit installation section 35 are disposed at a single location outside (in the −Z direction from) the outer surface 24A of the control board 24 in the apparatus body 12.

Figure 6:
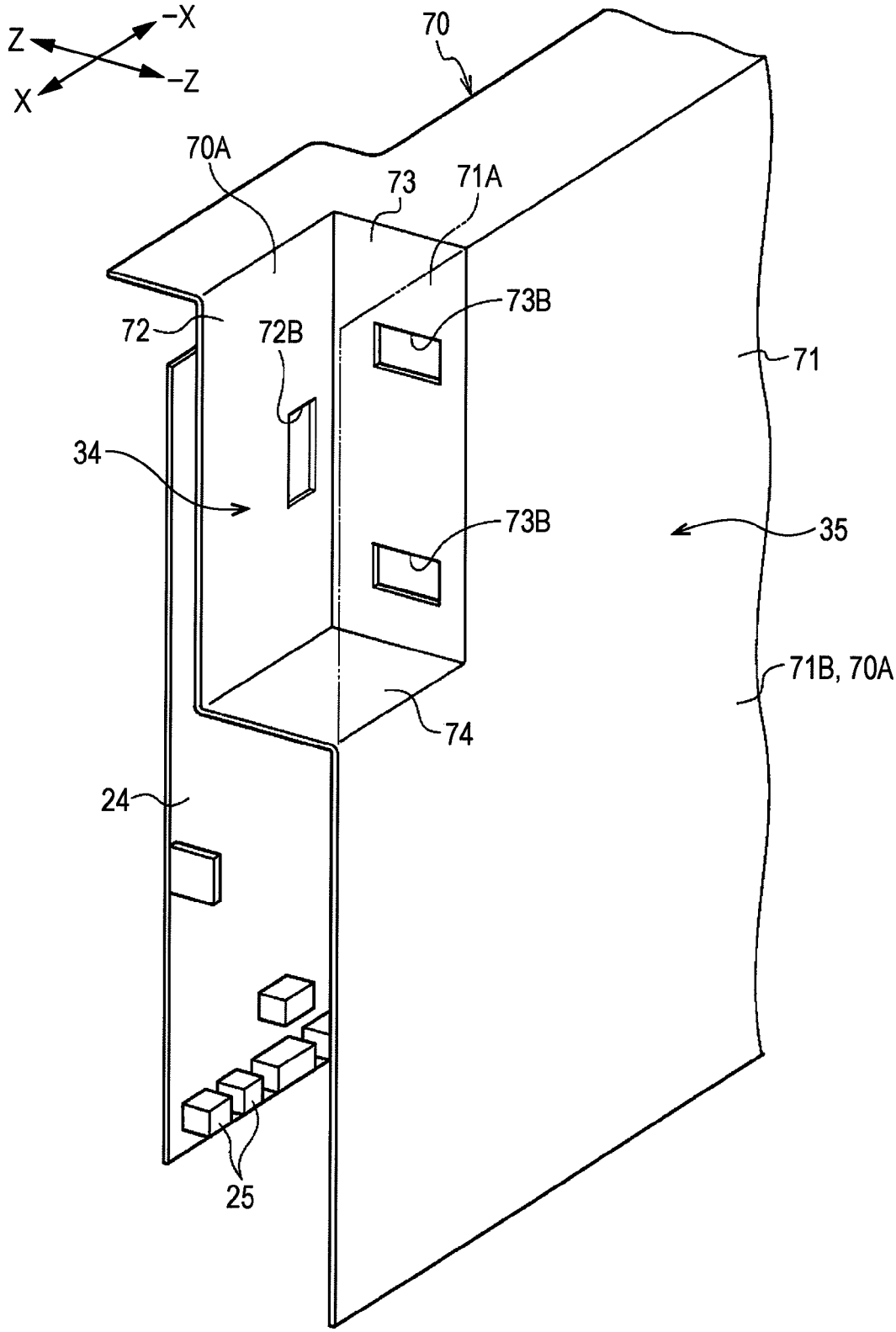
FIG. 6 is a perspective view illustrating the structure of a shield plate.

The shield plate 70 includes a first plate 71 that has a rectangular cut section 71A at the upper left corner thereof in FIG. 6; a rectangular second plate 72 that is disposed in the area corresponding to the cut section 71A when viewed in the Z direction and that is closer to the control board 24 than the first plate 71; a third plate 73 that connects the second plate 72 to the first plate 71 at an end of the second plate 72 in the −X direction; and a fourth plate 74 that connects the second plate 72 to the first plate 71 at the bottom of the second plate 72. The shield plate 70 may either have an integral structure or be formed by assembling plural plates.

The third plate 73 faces the protruding frame 20C of the body frame 20 (see FIG. 5). A part of the outer cover 22 faces the fourth plate 74 at a position above the fourth plate 74 (see FIG. 4). The part of the outer cover 22, the protruding frame 20C, the third plate 73, the fourth plate 74, and the second plate 72 define a rectangular parallelepiped space that is open at the −Z direction side thereof. This space serves as an installation space in which the network card 40 is installed in the card installation section 34. The network card 40 is installed into the installation space in the Z direction (installation direction) through the opening at the −Z direction side, and is removed from the installation space in the −Z direction (removing direction). Thus, the card installation section 34 is formed as a part of the shield plate 70.

An opening 21 through which an external connector 48, which will be described below, is inserted is formed in each of the protruding frame 200 and the outer cover 22 that covers the outer side (X direction side) of the protruding frame 20C. Two openings 73B from which parts of leaf springs 36, which will be described below, project are formed vertically next to each other in the third plate 73. The second plate 72 has an opening 72B at which the control-board connector 26 on the control board 24 is exposed rearward (in the −Z direction).

As illustrated in FIG. 7, the unit installation section 35 is provided on an outer surface 71B of the first plate 71. Threaded holes 71C and 71D into which hand screws 58C and 58D are respectively screwed are formed in the outer surface 71B of the first plate 71. The hand screws 58C and 58D are attachment members used to attach the facsimile unit 50. A hook 71E is also formed on the outer surface 71B of the first plate 71. The hook 71E serves as a hook member to be hooked to an opening 51, which serves as a hook-receiving member, in the facsimile unit 50.

The unit installation section 35 is in the −Z direction from the card installation section 34, and is farther away from the control board 24 than the card installation section 34 in the −Z direction. Therefore, a space is provided on the −Z direction side of the control board 24 in an area where the unit installation section 35 is arranged. In this area, the height (dimension in the Z direction) of mounted components mounted on the control board 24 is less limited compared to that in an area where the card installation section 34 is arranged.

The card installation section 34 and the unit installation section 35 do not overlap in the Z direction. The card installation section 34 is arranged to be placed obliquely upward from the unit installation section 35. Accordingly, the card installation section 34 and the unit installation section 35 are individually accessible. The card installation section 34 is disposed at an upper corner of the installation area 13, so that the card installation section 34 is easily recognizable by a user.

The facsimile unit 50 includes a substrate 52 (see FIG. 4) and a casing 54 in which the substrate 52 is stored. The casing 54 is provided with a first plate portion 54A that serves as a first attachment portion and a second plate portion 54B that serves as a second attachment portion. The first plate portion 54A protrudes upward from the casing 54, and the second plate portion 54B protrudes sideways (in the −X direction)

from the casing 54. The first plate portion 54A has the opening 51, which serves as the hook-receiving member for receiving the hook 71E, and a through hole 54C through which the hand screw 58C is inserted. The second plate portion 54B has a through hole 54D through which the hand screw 58D is inserted.

With the above-described structure, to install the facsimile unit 50 into the unit installation section 35, the hook 71E of the first plate 71 is inserted into the opening 51 in the first plate portion 54A, and the hand screw 58C is inserted through the through hole 54C in the first plate portion 54A and screwed into the tapped hole 71C in the first plate 71. In addition, the hand screw 58D is inserted through the through hole 54D in the second plate portion 54B and screwed into the tapped hole 71D in the first plate 71.

When the facsimile unit 50 is installed into the unit installation section 35, the casing 54 is electrically connected to the body frame 20, which serves as the point of reference potential, through the shield plate 70. Accordingly, the casing 54 electrically shields the substrate 52 so that the influence of electrical noise on the substrate 52 may be reduced. The casing 54 covers the entire periphery of the substrate 52, that is, in the vertical directions, the −Z and Z directions, and the −X and X directions, thereby protecting the substrate 52 from an external force.

A facsimile-unit connector 55 that provides an electrical connection to the control board 24 is provided on the substrate 52. The facsimile-unit connector 55 may be connected to a connector 23 on the control board 24 with a cable 57.

Figure 8:
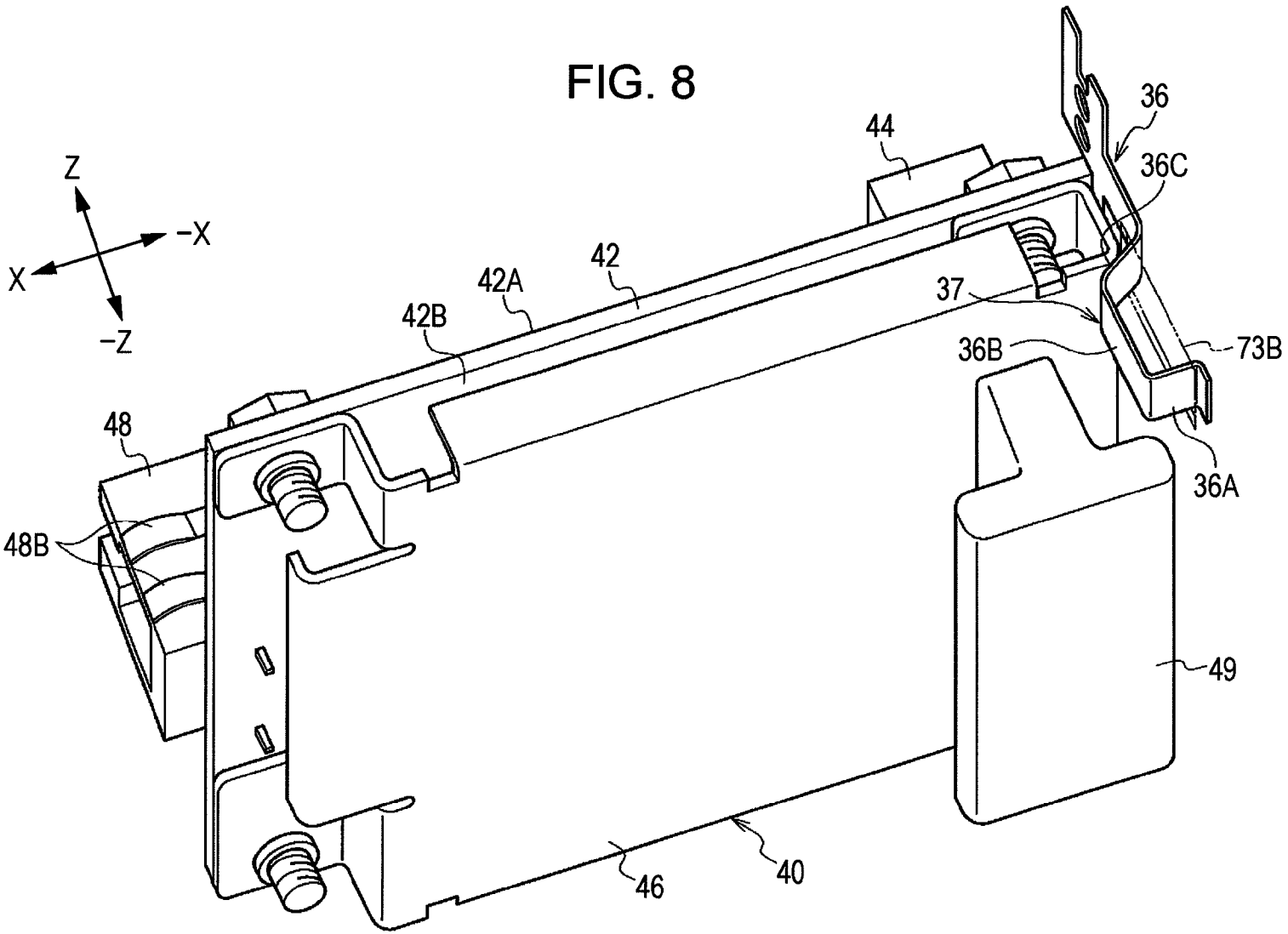
FIG. 8 is a perspective view illustrating the structure of the network card.

As illustrated in FIGS. 5 and 8, the network card 40 includes a substrate 42 on which electronic components are arranged. The network card 40 is installed into the card installation section 34 in the thickness direction of the control board 24 (Z direction) so that a surface of the substrate 42 at one side (Z direction side) thereof (hereinafter referred to as an inner surface 42A) faces the control board 24.

A network-card connector 44, which is an example of a second connection terminal, is provided on the inner surface 42A of the substrate 42. The network-card connector 44 is connected to the control-board connector 26 when the network card 40 is installed in the card installation section 34. The network-card connector 44 is disposed on the substrate 42 at a first end of the substrate 42 in an in-plane direction thereof (end in the −X direction). Unlike the facsimile unit 50 in which the connectors are connected to each other with the cable 57, the network-card connector 44 directly connects the substrate 42 to the control board 24 without using a cable. The in-plane direction of the substrate 42 is a direction along the plane of the substrate 42, that is, a direction orthogonal to the thickness direction of the substrate 42.

A protection plate 46 is provided adjacent to a surface of the substrate 42 at the other side (−Z direction side) thereof (hereinafter referred to as an outer surface 42B). The protection plate 46 is an example of a second electrical connection member that is electrically connected to the body frame 20, which serves as the point of reference potential, by the leaf springs 36, which will be described below. When the network card 40 is installed into the card installation section 34, the protection plate 46 comes into contact with the leaf springs 36, which will be described below, so that the protection plate 46 is electrically connected to the body frame 20, which serves as the point of reference potential, by the leaf springs 36. Thus, the protection plate 46 electrically shields the substrate 42 and the influence of electrical noise on the substrate 42 may be reduced. The protection plate 46 is large enough to cover the entire area of the outer surface 42B of the substrate 42, and protects the substrate 42 from an external force.

A grip portion 49 that may be held when the network card 40 is installed into the card installation section 34 is provided on an outer surface 46B (surface at the −Z direction side) of the protection plate 46. The grip portion 49 is disposed on the protection plate 46 at a first end thereof in the in-plane direction of the substrate 42 (end in the −X direction) at a position behind (at the side opposite to) the network-card connector 44.

The external connector 48 is provided on the substrate 42 of the network card 40. The external connector 48 is an example of an external connection terminal that is externally exposed to allow an external device to be connected thereto in the state in which the network card 40 is installed in the card installation section 34.

The external connector 48 is provided on the substrate 42 so as to project therefrom at a second end of the substrate 42 in the in-plane direction thereof (end in the X direction). The network card 40 is installed into the card installation section 34 after the external connector 48 is inserted through the openings 21 in the protruding frame 20C and the outer cover 22. Accordingly, the external connector 48 is externally exposed in the state in which the network card 40 is installed in the card installation section 34.

A leaf spring 48A that is convex in the Z direction is provided on a surface of the external connector 48 at an end thereof in the Z direction (see FIG. 5), and leaf springs 48B that are upwardly convex are provided on the top surface of the external connector 48 (see FIG. 8). When the network card 40 is installed into the card installation section 34, the leaf springs 48A and 48B come into contact with the edges of the opening 21 in the protruding frame 20C and are electrically connected to the body frame 20, which serves as the point of reference potential.

In the present exemplary embodiment, the user installs the network card 40 into the card installation section 34 after inserting the external connector 48 through the openings 21 in the protruding frame 20C and the outer cover 22 while holing the network card 40 in an inclined manner. The width of the space in the card installation section 34 in the X direction is set so that the network card 40 cannot be fitted into the space if the network card 40 is inserted while being parallel to the second plate 72 without inserting the external connector 48 through the openings 21 or if the network card 40 is inserted while being inclined in the opposite direction (direction opposite to that illustrated in FIG. 9).

The card installation section 34 may be formed in a trapezoidal shape in plan view so that the width of the space in the X direction is large at the end thereof in the −Z direction (upstream end in the installation direction) and is small at the end thereof in the Z direction (downstream end in the installation direction).

Figure 9:
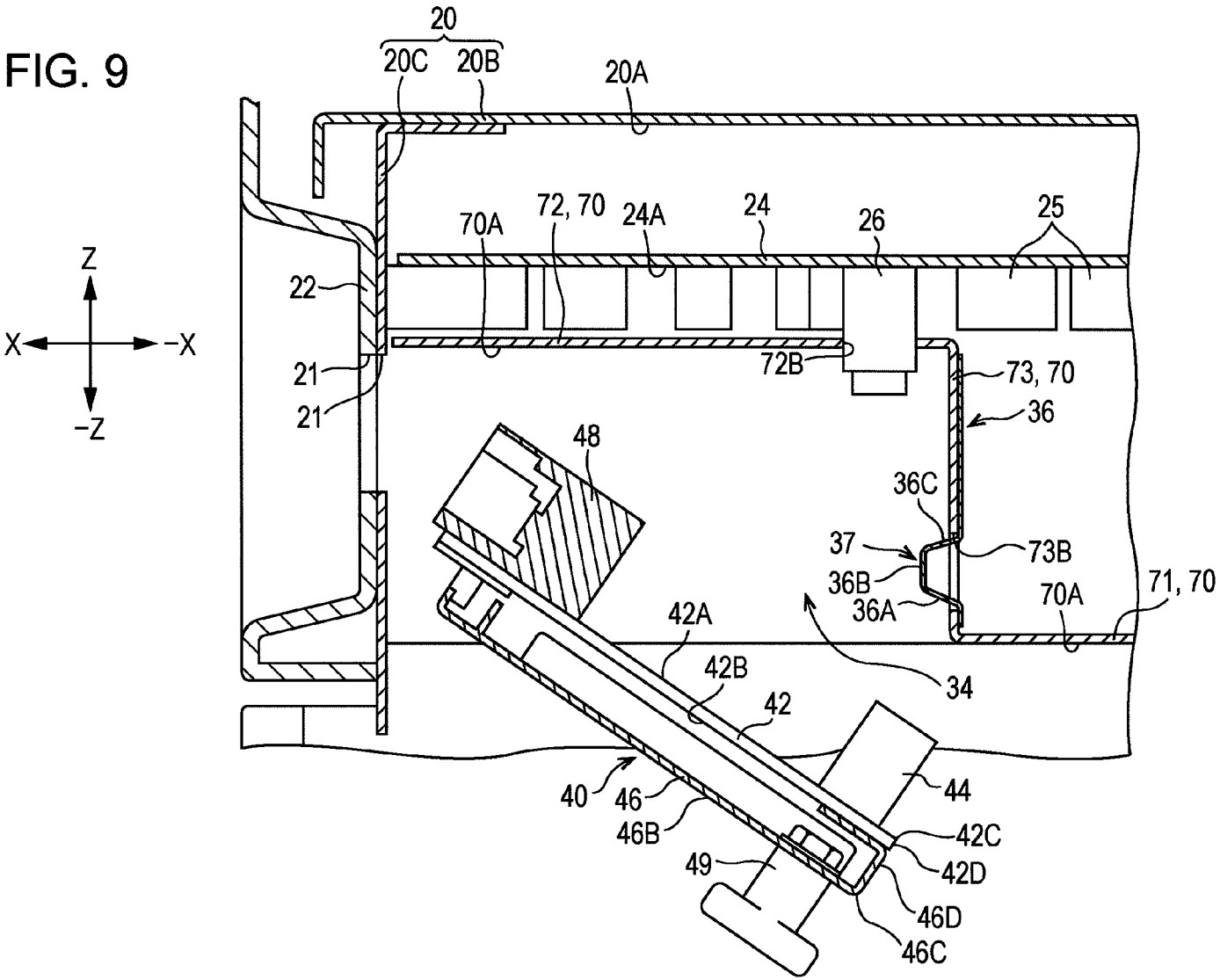
FIG. 9 is a sectional plan view illustrating an operation of installing the network card into the card installation section.

Referring to FIGS. 8 and 9, the leaf springs 36, which are examples of a first electrical connection member that is electrically connected to the point of reference potential, are provided on the card installation section 34 into which the network card 40 is installed. More specifically, two leaf springs 36 are vertically arranged next to each other at the end of the card installation section 34 in the −X direction at positions where the leaf springs 36 face the openings 21 in the protruding frame 20C and the outer cover 22. The leaf springs 36 are fixed to the surface of the third plate 73 at the −X direction side, and are electrically connected to the body frame 20, which serves as the point of reference potential, through the shield plate 70.

Each leaf spring 36 is bent so that a first inclined surface 36A, a flat surface 36B, and a second inclined surface 36C are formed. The first inclined surface 36A is inclined in a manner such that an end thereof in the X direction is in the Z direction with respect to an end thereof in the −X direction. The second inclined surface 36C is inclined in a manner such that an end thereof in the −X direction is in the Z direction with respect to an end thereof in the X direction.

The first inclined surface 36A, the flat surface 36B, and the second inclined surface 36C serve as a contact portion that comes into contact with the substrate 42 and the protection plate 46 of the network card 40. The contact portion serves as a projecting portion 37 that projects in the X direction from the corresponding opening 73B in the third plate 73.

Each leaf spring 36 is elastically deformed when the network card 40 is installed into the card installation section 34, and functions as an elastic member that applies an elastic force for moving the substrate 42 deeper into the card installation section 34.

Figure 10:
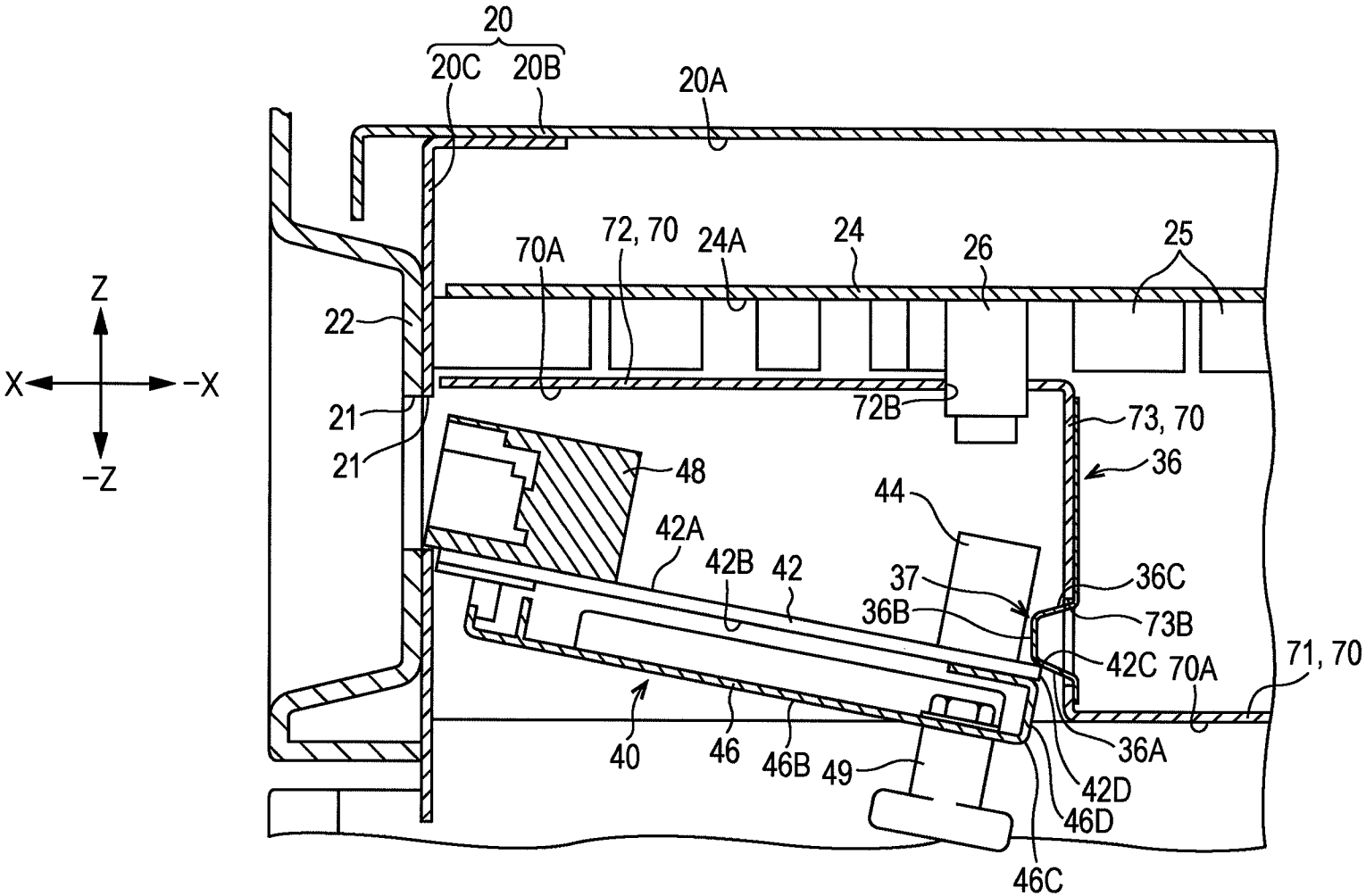
FIG. 10 is a sectional plan view illustrating the operation of installing the network card into the card installation section.

The operation of installing the network card 40 into the card installation section 34 after inserting the external connector 48 into the openings 21 in the protruding frame 20C and the outer cover 22 is started as illustrated in FIG. 9. Then, as illustrated in FIG. 10, the inner surface 42A or a corner portion 42C of the substrate 42 comes into contact with the first inclined surface 36A of each leaf spring 36. As the network card 40 is moved in the Z direction, the projecting portion 37 of the leaf spring 36 is pushed in the −X direction. As a result, the leaf spring 36 is elastically deformed.

Figure 11:
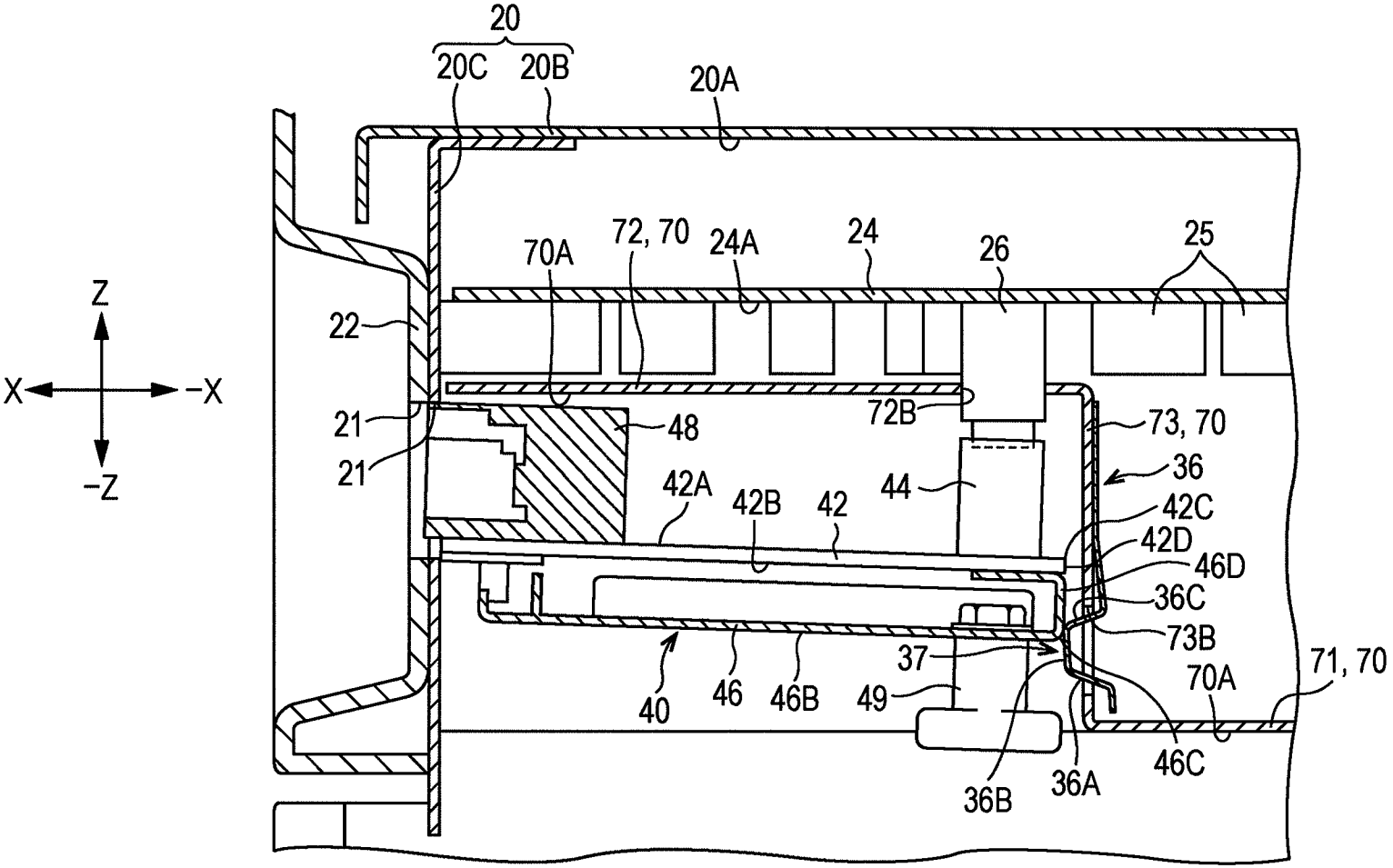
FIG. 11 is a sectional plan view illustrating the operation of installing the network card into the card installation section.
Figure 12:
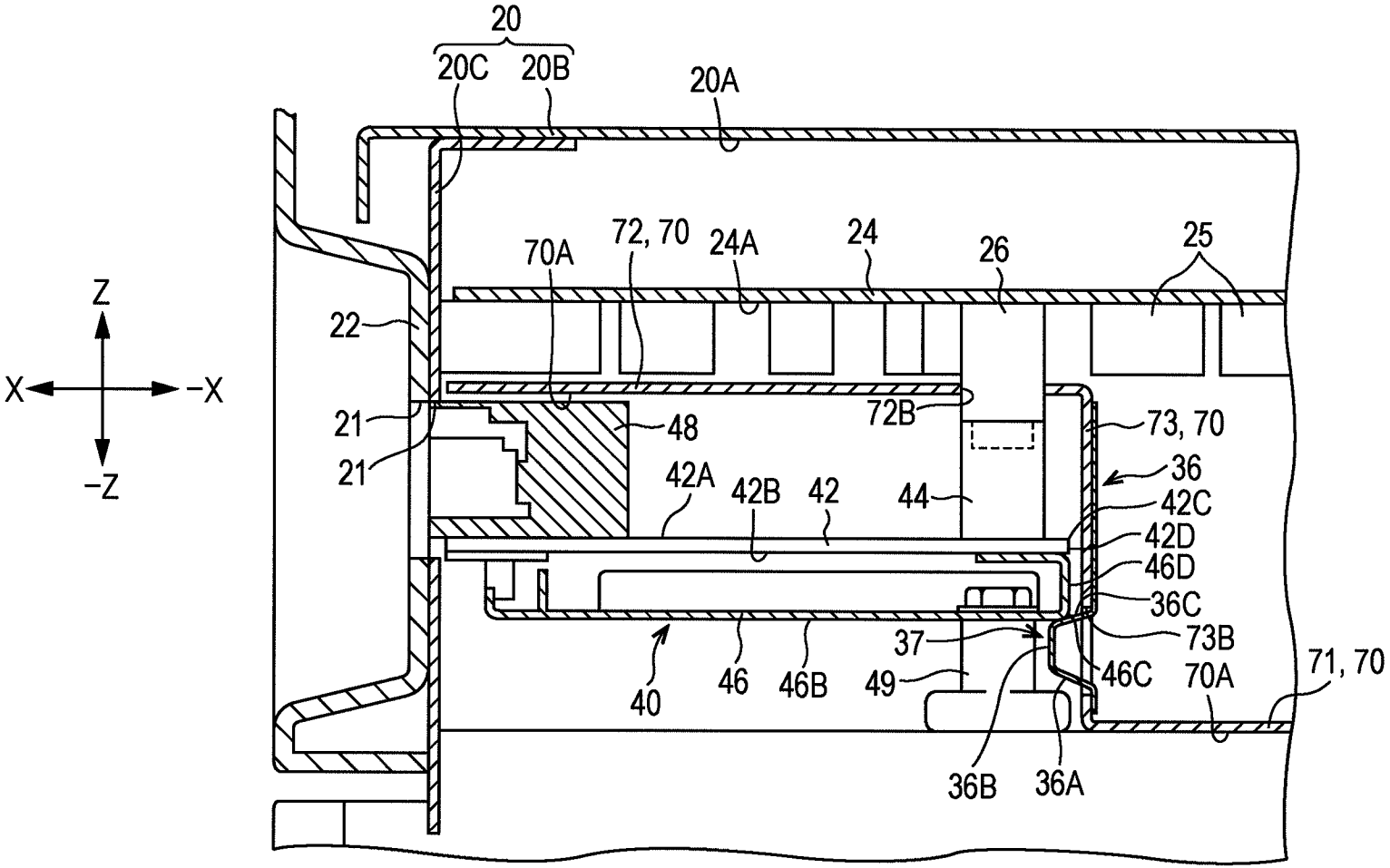
FIG. 12 is a sectional plan view illustrating the state in which the network card is installed into the card installation section.

As the network card 40 is moved further in the Z direction and the projecting portion 37 of each leaf spring 36 is pushed further in the −X direction, an end surface 42D of the substrate 42 and an end surface 46D of the protection plate 46 of the network card 40 move in the Z direction while being in contact with the flat surface 36B, as illustrated in FIG. 11. When the network card 40 is moved further in the Z direction and the end surface 46D of the protection plate 46 is moved beyond the flat surface 36B, the second inclined surface 36C of the leaf spring 36 comes into contact with the outer surface 46B or a corner portion 46C of the protection plate 46, as illustrated in FIG. 12. Thus, the substrate 42 is moved deeper into the card installation section 34 (in the Z direction) by the elastic force of the leaf spring 36.

In the state in which the network card 40 is installed in the card installation section 34, the state in which each leaf spring 36 is in contact with the protection plate 46 is maintained by the elastic force applied by the leaf spring 36. In addition, the protection plate 46 is pushed toward the shield plate 70 (in the Z direction) by the leaf spring 36, so that the network card 40 is restrained from moving in the −Z direction.

Thus, each leaf spring 36 serves as a restraining portion that comes into contact with the network card 40 installed in the card installation section 34 at the first end of the substrate 42 in the in-plane direction thereof (end in the −X direction) and restrains the network card 40 from moving in a direction in which the network card 40 is removed from the card installation section 34 (−Z direction) at the first end of the substrate 42 in the in-plane direction thereof.

In the state in which the network card 40 is installed in the card installation section 34, the network card 40 is placed on the fourth plate 74 of the shield plate 70 without being fixed to the card installation section 34 with screws or the like. An end portion of the network card 40 in the X direction is positioned by bringing the external connector 48 into contact with the edges of the opening 21 in the protruding frame 20C. An end portion of the network card 40 in the −X direction is positioned by being restrained from moving in the −Z direction by each leaf spring 36. The external connector 48 may be configured so as to come into contact with the edges of both of the opening 21 in the protruding frame 20C and the opening 21 in the outer cover 22.

Operation of Present Exemplary Embodiment

Operations of the present exemplary embodiment will now be descried.

An operation of installing the facsimile unit 50 and the network card 40 to the unit installation section 35 and the card installation section 34, respectively, in the image forming apparatus 10 according to the present exemplary embodiment will now be explained.

To install the facsimile unit 50 and the network card 40, first, the cover 18 is removed from the apparatus body 12 so that the card installation section 34 and the unit installation section 35 are exposed, as illustrated in FIG. 7.

To install the facsimile unit 50 in the unit installation section 35, first, the hook 71E on the first plate 71 is inserted into the opening 51 in the first plate portion 54A of the facsimile unit 50.

Then, the hand screw 58C is inserted through the through hole 54C in the first plate portion 54A and screwed into the tapped hole 71C in the first plate 71. In addition, the hand screw 58D is inserted through the through hole 54D in the second plate portion 54B and screwed into the tapped hole 71D in the first plate 71. Thus, the facsimile unit 50 is installed in the unit installation section 35. The facsimile-unit connector 55 on the substrate 52 in the facsimile unit 50 is electrically connected to the connector 23 on the control board 24 with the cable 57.

To install the network card 40 in the card installation section 34, first, the operator (user) hold the grip portion 49 on the network card 40 and inserts the external connector 48 into the openings 21 in the protruding frame 20C and the outer cover 22 while holding the network card 40 in an inclined manner, as illustrated in FIG. 9.

Next, the operator pushes the grip portion 49 in the thickness direction of the control board 24 (in the Z direction) in a manner such that the inner surface 42A of the substrate 42 faces the control board 24. Thus, the network card 40 is installed into the card installation section 34 in the thickness direction of the control board 24 (in the Z direction).

When the network card 40 is inserted into the card installation section 34, as illustrated in FIG. 10, the inner surface 42A or the corner portion 42C of the substrate 42 comes into contact with the first inclined surface 36A of each leaf spring 36. When the network card 40 is moved further in the Z direction, the projecting portion 37 of the leaf spring 36 is pushed in the −X direction and the leaf spring 36 is elastically deformed.

As the network card 40 is moved further in the Z direction and the projecting portion 37 of each leaf spring 36 is pushed further in the −X direction, the end surface 42D of the substrate 42 and the end surface 46D of the protection plate 46 of the network card 40 move in the Z direction while being in contact with the flat surface 36B, as illustrated in FIG. 11.

When the network card 40 is moved further in the Z direction and the end surface 46D of the protection plate 46 is moved beyond the flat surface 36B, the second inclined surface 36C of the leaf spring 36 makes contact with the outer surface 46B or the corner portion 46C of the protection plate 46, as illustrated in FIG. 12. Thus, the substrate 42 is moved deeper into the card installation section 34 (in the Z direction) by the elastic force of the leaf spring 36.

In the state in which the network card 40 is installed in the card installation section 34, the state in which each leaf spring 36 is in contact with the protection plate 46 is maintained by the elastic force applied by the leaf spring 36. In addition, the protection plate 46 is pushed toward the shield plate 70 (in the Z direction) by the leaf spring 36, so that the network card 40 is restrained from moving in the −Z direction. Thus, the network card 40 is positioned in the −X direction by the leaf springs 36.

In addition, in the state in which the network card 40 is installed in the card installation section 34, the state in which the external connector 48 is inserted through the openings 21 in the protruding frame 20C and the outer cover 22 is maintained. The leaf springs 48A and 48B on the external connector 48 are in contact with the edges of the opening 21 in the protruding frame 20C, so that the external connector 48 is electrically connected to the body frame 20 and is prevented from moving relative to the opening 21. Thus, the end portion of the network card 40 in the X direction is positioned by the external connector 48.

When the network card 40 is installed into the card installation section 34, the network-card connector 44 on the substrate 42 is connected to the control-board connector 26 on the control board 24 by being inserted thereinto. In addition, the protection plate 46 comes into contact with each leaf spring 36 and is electrically connected to the body frame 20, which serves as the point of reference potential, by the leaf spring 36. In the state in which the substrate 42 is installed in the card installation section 34, the external connector 48 is externally exposed to allow an external device to be connected thereto.

Thus, when the substrate 42 is installed in the card installation section 34, the substrate 42 is electrically connected to the control board 24 and the protection plate 46 that reduces the influence of electrical noise on the substrate 42 is electrically connected to the body frame 20. It may not be necessary to perform operations for achieving theses connections independently of the installing operation.

In the present exemplary embodiment, the grip portion 49 is provided on the network card 40 at the front side, that is, at the upstream side in the direction in which the network card 40 is installed into the card installation section 34. Therefore, the network card 40 may be easily pushed into the card installation section 34. This provides high operability in installing the substrate 42 into the card installation section 34. The grip portion 49 is disposed on the network card 40 at a first end thereof in the in-plane direction of the substrate 42 (end in the −X direction). This may provides high operability in inserting the external connector 48 at the second end of the substrate 42 in the in-plane direction thereof (end in the X direction) into the openings 21 in the protruding frame 20C and the outer cover 22 while holding the network card 40 in an inclined manner.

In the present exemplary embodiment, the grip portion 49 is arranged at a position behind the network-card connector 44. Therefore, the network-card connector 44 may be connected to the control-board connector 26 with a relatively small operational force.

In the present exemplary embodiment, in the state in which the network card 40 is installed in the card installation section 34, a portion of the network card 40 at the first end thereof in the in-plane direction (end in the −X direction) is restrained from moving in the −Z direction by each leaf spring 36. In addition, the external connector 48 on the substrate 42 at the second end thereof in the in-plane direction (end in the X direction) is in contact with the edges of the openings 21 in the protruding frame 20C and the outer cover 22. Therefore, the network card 40 installed in the card installation section 34 is not easily removed from the card installation section 34.

In the present exemplary embodiment, the card installation section 34 is arranged to be displaced obliquely upward from the unit installation section 35. Accordingly, the network card 40 and the facsimile unit 50 may be respectively installed in the card installation section 34 and the unit installation section 35 independently of each other. Therefore, the order in which the network card 40 and the facsimile unit 50 are installed is not limited.

In addition, in the present exemplary embodiment, the protection plate 46 has a function of protecting the Substrate 42 from an external force and a function of reducing the influence of electrical noise on the substrate 42. Thus, protection against an external force and reduction of the influence of electrical noise on the substrate may be achieved with a small number of components.

In addition, in the present exemplary embodiment, the card installation section 34 is a part of the shield plate 70 and serves to reduce the influence of electrical noise on the control board 24. Thus, formation of the card installation section 34 and reduction of the influence of electrical noise on the control board 24 may be achieved with a small number of components.

In addition, in the present exemplary embodiment, the leaf springs 36 have a function of electrically connecting the protection plate 46 to the body frame 20, which functions as the point of reference potential, and a function of restraining the movement of the network card 40 at the first end thereof in the in-plane direction. Thus, restriction of movement of the network card 40 at the first end thereof in the in-plane direction and the electrical connection between the protection plate 46 and the point of reference potential may be achieved with a small number of components.

In the present exemplary embodiment, the network card 40 is described as an example of a card installed in the card installation section 34. However, other types of additional components may be installed as long as the additional components include substrates.

The present exemplary embodiment is not limited to the above-described exemplary embodiment, and various modifications, alterations, and improvements are possible. For example, the above-described modifications may be implemented in combination as appropriate.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a control board that is provided in an apparatus body and controls an image forming operation;

a first connection terminal provided on an outer surface of the control board;

an installation section disposed at the outer surface side of the control board in the apparatus body;

a substrate capable of being installed into the installation section in a thickness direction of the control board in a manner such that a first surface of the substrate faces the outer surface of the control board;

a second connection terminal provided on the first surface of the substrate, the second connection terminal being connected to the first connection terminal when the substrate is installed into the installation section;

a grip portion provided on a second surface of the substrate at a first end of the substrate in an in-plane direction; and an external connection terminal provided on the substrate so as to project from the substrate at a second end of the substrate in the in-plane direction, the external connection terminal being externally exposed to allow an external device to be connected to the external connection terminal when the substrate is installed into the installation section after the external connection terminal is inserted through an opening in the apparatus body.

2. The image forming apparatus according to claim 1, wherein the grip portion is disposed at a position behind the second connection terminal.

3. The image forming apparatus according to claim 1, further comprising:

a restraining portion that is provided on the installation section so as to face the opening in the apparatus body and that makes contact with the substrate installed in the installation section at the first end in the in-plane direction so as to restrain a movement of the substrate in a direction in which the substrate is removed from the installation section at the first end in the in-plane direction.

4. The image forming apparatus according to claim 2, further comprising:

a restraining portion that is provided on the installation section so as to face the opening in the apparatus body and that makes contact with the substrate installed in the installation section at the first end in the in-plane direction so as to restrain a movement of the substrate in a direction in which the substrate is removed from the installation section at the first end in the in-plane direction.

5. The image forming apparatus according to claim 3, wherein the restraining portion is formed of a first electrical connection member provided on the installation section and electrically connected to a point of reference potential, and wherein a second electrical connection member is provided on the second surface of the substrate, the second electrical connection member making contact with the first electrical connection member and being electrically connected to the point of reference potential via the first electrical connection member when the substrate is installed into the installation section.

6. The image forming apparatus according to claim 4, wherein the restraining portion includes a first electrical connection member provided on the installation section and electrically connected to a point of reference potential, and wherein a second electrical connection member is provided on the second surface of the substrate, the second electrical connection member making contact with the first electrical connection member and being electrically connected to the point of reference potential via the first electrical connection member when the substrate is installed into the installation section.

7. An image forming apparatus comprising:

a control board that is provided in an apparatus body and controls an image forming operation;

a first connection terminal provided on an outer surface of the control board; and an installation section disposed at the outer surface side of the control board in the apparatus body, wherein the installation section forms an installation area in which a substrate is installable in a thickness direction of the control board in a manner such that a first surface of the substrate faces the outer surface of the control board, a second connection terminal being provided on the first surface of the substrate and connected to the first connection terminal when the substrate is installed into the installation section, a grip portion being provided on a second surface of the substrate at a first end of the substrate in an in-plane direction, and an external connection terminal being provided on the substrate so as to project from the substrate at a second end of the substrate in the in-plane direction and externally exposed to allow an external device to be connected to the external connection terminal when the substrate is installed into the installation section after the external connection terminal is inserted through an opening in the apparatus body.

8. The image forming apparatus according to claim 7, wherein the installation area is separated from an area where the control board is accommodated.

* * * * *